US007628128B2

(12) United States Patent
Naumann

(10) Patent No.: US 7,628,128 B2
(45) Date of Patent: Dec. 8, 2009

(54) GUIDE SYSTEMS FOR VARIABLE VALVE CONTROLLER

(75) Inventor: Herbert Naumann, Elmshorn (DE)

(73) Assignee: ThyssenKrupp Presta TecCenter AG, Eschen (LI)

( * ) Notice: Subject to any disclaimer, the term of this patent is extended or adjusted under 35 U.S.C. 154(b) by 0 days.

(21) Appl. No.: 10/941,617

(22) Filed: Sep. 15, 2004

(65) Prior Publication Data

US 2005/0045125 A1 Mar. 3, 2005
US 2008/0105228 A9 May 8, 2008

Related U.S. Application Data

(63) Continuation of application No. PCT/EP03/03262, filed on Mar. 28, 2003.

(51) Int. Cl.
*F01L 1/18* (2006.01)

(52) U.S. Cl. ..... 123/90.39; 123/90.16; 74/569

(58) Field of Classification Search ..... 123/90.16, 123/90.2, 90.39, 90.44, 90.41, 90.27, 90.31; 74/559, 567, 569
See application file for complete search history.

(56) References Cited

U.S. PATENT DOCUMENTS 6,439,177 B2 * 8/2002 Pierik ..... 123/90.16
6,886,512 B2 * 5/2005 Naumann ..... 123/90.39

FOREIGN PATENT DOCUMENTS

EP 1072762 A2 * 1/2001

* cited by examiner

*Primary Examiner*—Ching Chang
(74) *Attorney, Agent, or Firm*—Crowell & Moring LLP

(57) ABSTRACT

The invention relates to space-saving, easily-assembled guide systems for mechanical, variable value controllers, cam followers (1), driven by a cam (6) via a cam roller (5), the pivot joint (2) of which, for driving a tappet (4) which operates the value (3), is arranged in the tappet (4), or the pivot joint for the adjustment thereof runs in an arc around the axis of rotation of a roller, which is arranged on a tappet operating a value. The cam followers drive the tappets by means of the contact surface with the roller thereof. The guide systems are embodied with slide blocks (11), adjustable within slide housings (10), guide arms mounted in rollers and guide levers mounted in crank levers. According to application, the guide systems comprise contact surfaces, rollers or pivot joints.

7 Claims, 3 Drawing Sheets

GUIDE SYSTEMS FOR VARIABLE VALVE CONTROLLER

This application is a continuation of International Application No. PCT/EP03/03262, filed Mar. 28, 2003, and claims the benefit of priority to German patent application 102 14 802.3, filed Apr. 4, 2002.

BACKGROUND OF THE INVENTION

The present invention concerns space-saving and easily assembled systems for guiding mechanical and variable valve controls. Each system includes a rocker and a walker. The rocker is driven by a cam by way of a follower. The rocker is articulated to and drives the walker by way of a swivel accommodated on the walker. The swivel can be shifted by a steering mechanism along the arc of a circle or along a similar curve around the axis of rotation of a follower mounted on the walker that actuates the valve. The rocker drives the walker by way of an engagement contour and by means of a follower.

The rocker can alternatively drive the walker by way of an engagement contour that arches outward in the form of an arc of a circle, in which case the rocker can be shifted along the arc of a circle or along a similar curve around the axis of the arching engagement contour.

The rocker can alternatively be driven by a cam by way of an engagement contour.

The rocker can alternatively drive one-armed and two-armed levers.

Valve controls wherein the rocker's swivel can be shifted in a circular path around the axis of rotation of a follower accommodated in the walker and engaged by the rocker are disclosed in German Application 10 136 612.4.

The valve controls disclosed in German Application 10 155 007.3 feature an engagement contour or a follower shifted along a circular path by a shift and engaged either by a rocker and a follower or by an engagement contour, whereby the rockers drive a valve-actuating walker by way of a swivel.

The valve controls disclosed in German Application 10 136 612.4 feature a shift that shifts a swivel along a circular path, whereby a rocker is articulated to the swivel and drives a valve-actuating walker by way of a follower.

The shifts in these embodiments can be complicated to install because of lack of space or of assembly problems, and can also be too delicate, in that the swivels lie along the axis of rotation of the swivel accommodated on the walker and in reach as long as the valve remains closed or along that of the follower accommodated on the walker.

SUMMARY OF THE INVENTION

The present invention accordingly concerns three different embodiments that take up little space and are easy to install. FIGS. 1 and 2 depict a mechanism for setting valve controls. A flat or sliding block has similarly curved and mutually engaging tracks inside a case. The flat is provided with an engagement contour that acts as a cam. The engagement contour is engaged by a follower mounted on a rocker. Alternatively, the flat itself can be provided with a follower that operates in conjunction with an engagement contour on the rocker that acts as a cam. The flat itself can also alternatively be provided with a swivel.

FIG. 3 depicts another embodiment of a mechanism for setting valve controls. A contoured flat is secured between two banking rollers, one on each side, or more. The rollers are provided with flanges. The flat is provided with a follower that engages an engagement contour on a rocker.

Alternatively, the flat itself can be provided with either a follower for engaging the engagement contour on a rocker or with a swivel for guiding a rocker.

FIG. 4 depicts still another embodiment of a mechanism for setting valve controls. A steering lever is supported at two points by swivels accommodated on two crankshafts or camshafts. The angled end of the lever is provided with a swivel for guiding the engagement contour of a rocker. A slide in the form of a flat must be provided in this case to position the engagement contour for engagement by a follower. The situation is more complicated in that the steering lever must be supported at two swiveling points by two contoured flats.

DETAILED DESCRIPTION OF THE INVENTION

Figure 1:
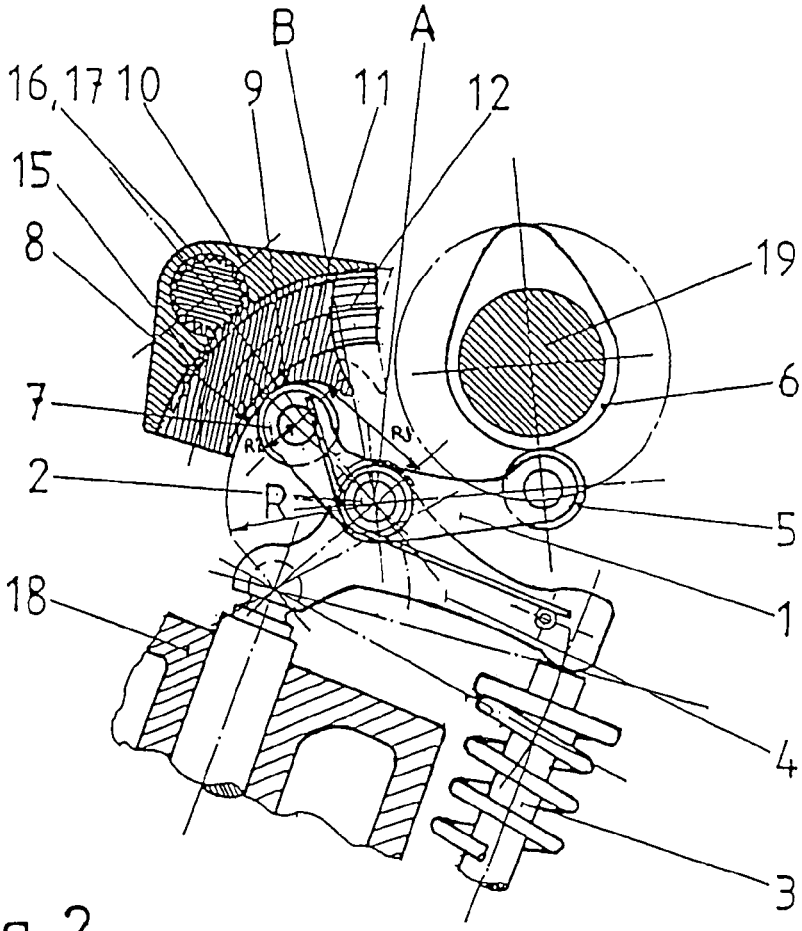
FIGS. 1 and 2 show a mechanism for setting valve controls, in accordance with the present invention.

FIG. 1 illustrates an assembly for mechanically setting variable valve controls. The assembly includes a rocker 1, a walker 4, and a contoured flat 11. Rocker 1 has two arms and pivots around a swivel 2 mounted on walker 4. Walker 4 actuates a valve 3. Rocker 1 is driven by a cam 6 by way of a follower 5 mounted on the end of one arm. Mounted on the rocker's other arm is another follower 7 that follows the engagement contour of flat 11. Flat 11 slides clockwise and counterclockwise inside a case 10 around the axis of swivel 2 while the swivel remains in the position it is in as long as valve 3 is closed. The flat's engagement contour is divided into two segments 8 and 9. Segment 8 participates in maintaining valve 3 closed, and segment 9 in allowing the valve to open. Segment 8 curves inward with a radius R. Radius R is the radius of a circle centered on the axis of swivel 2 as long as valve 3 is closed. Segment 9 terminates in a spur that extends inward and considerably beyond segment 8. The length of radius R equals the length of a radius R1 extending from the axis of swivel 2 to the axis of follower 7 plus the length of a radius R2 extending from the axis of follower 7 to its circumference.

Figure 2:
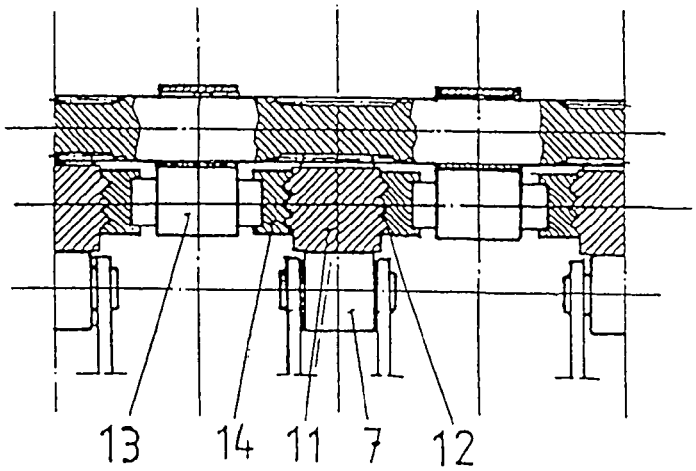

FIG. 2 is a cross-section through a case 10 to be employed with a cylindrical alignment of such assemblies. Each face of each flat 11 is, in this practical illustrated version, secured in case 10 by a longitudinal polyvinyl cogged section 12. Flat 11 is forced against the stationary cogged section 12 by an expanding component 14. Expanding component 14 is subject to the force of a ram 13. Expanding component 14 is maintained in the direction associated with setting the controls inside case 10 and is provided with a matching cogged section. This approach prevents play. In a cylindrical alignment, each expanding component 14 can be subject to the force of a ram 13 exerted from each side. Rams 13 derive their force mechanically from springs, from the pressure of the oil in an automotive lubrication system, or from both.

Flat 11 can alternatively be guided by other appropriate circular longitudinal cogged sections, mounted radially. Flat 11 is positioned by a cogged section 15 that engages a cogwheel 16 mounted on a rotating shaft 17.

Valve 3 will be maintained closed as long as the spur, the segment 9 of the engagement contour of flat 11, that is, remains in position A. Once the spur is in position B, however, the valve will be able to open with its longest and slowest stroke. As long as valve 3 is maintained closed, follower 7 will engage the circular segment 8 of the engagement contour of flat 11 without activating the valve. To actuate the valve, flat 11 will be shifted out of its valve-closed position and along the arc of a circle inside case 10 by a rotation of shaft 17, allowing the spur to be engaged by the follower 7 mounted on rocker 1. The extent of the engagement will determine the length and accordingly the duration of the opening stroke. Flat 11 can alternatively be positioned by an articulated rod driven for example by an eccentric shaft.

Assembly can be facilitated if case 10 and shaft 17 are integrated into bearing blocks screwed to cylinder head 18. The bearing blocks to be employed with a specific cylindrical alignment of such assemblies can be subassembled in advance along with cases 10, shaft 17, and flats 11, already accommodated inside the cases, as well as, when practical with the shaft 19 of cam 6 if they share the same bearing blocks, on a mount screwed to cylinder head 18.

Figure 3:
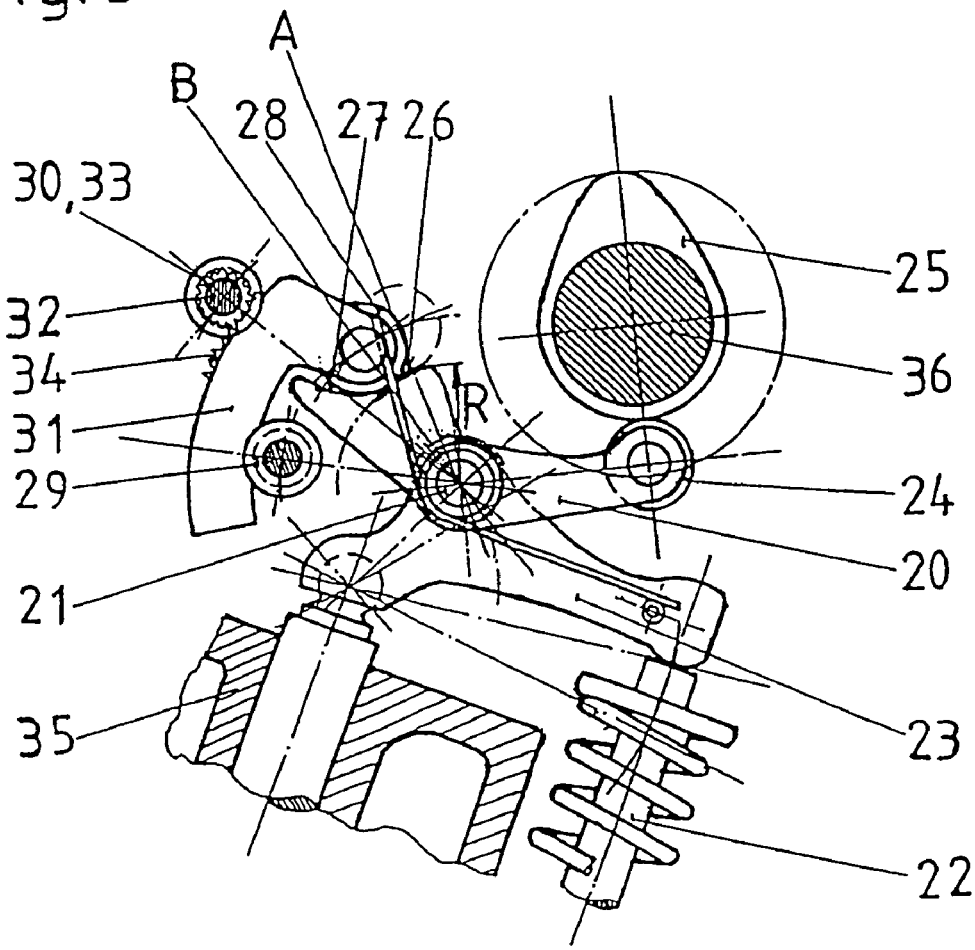
FIG. 3 shows another embodiment of a mechanism for setting valve controls.

FIG. 3 illustrates another embodiment of an assembly for mechanically guiding variable valve controls. The assembly includes a rocker 20 and a walker 23. Rocker 20 has two arms and pivots around a swivel 21 mounted on walker 23. Walker 23 actuates a valve 22. Rocker 20 is driven by a cam 25 by way of a follower 24 on the end of one arm. At the other end of the arm, rocker 20 is provided with an engagement contour. The engagement contour is divided into two curved segments 26 and 27. Segments 26 and 27 are engaged by a follower 28 mounted on a steering rod in the form of a similarly curved contoured flat 31. Contoured flat 31 is secured by two radial banking rollers 29 and 30, one on each engagement contour. Each banking roller has a flange on each face. Segment 26 participates in maintaining valve 22 closed, and segment 27 in allowing the valve to open. The longitudinal axis of contoured flat 31 extends concentric around the axis of the swivel 21 mounted on walker 23 that is in reach as long as valve 22 is closed. The segment 26 that participates in maintaining valve 22 closed curves outward in the form of an arc of a circle with a radius R. The center of the circle coincides with the axis of the swivel 21 mounted on walker 23. The segment 27 that participates in allowing the valve to remain open is provided with an outward-projecting spur that extends considerably beyond segment 26.

To allow adjustment of contoured flat 31, banking roller 30 is composed of two halves and mounted on a rotating shaft 32. Accommodated between the two halves is a cogwheel fixed tight to rotating shaft 32 and engaging a cogged section 34 of flat 31.

As long as the follower 28 mounted on contoured flat 31 remains in position A, valve 22 will be maintained closed. Once the follower is in position B, however, the valve will be able to open with its longest and slowest stroke. To maintain valve 22 closed, the outwardly curved segment 26 of the engagement contour will engage the follower 28 mounted on contoured flat 31 without activating valve 22. To actuate valve 22, shaft 32 is rotated, rotating in turn contoured flat 31, and the follower 28 mounted on it, out of the position wherein it participates in maintaining the valve closed until the spur extending out of segment 27 engages follower 28. The extent of engagement will determine the length and accordingly the duration of the opening stroke.

To eliminate play on the part of contoured flat 31, banking roller 29 is accommodated on an articulated lever and provides the flat with a stabilizing moment of rotation derived from a ram.

To simplify assembly, the axes of banking rollers 29 and 30 can be accommodated in bearing blocks screwed to a cylinder head 35. The bearing blocks associated with a particular cylindrical alignment of assemblies can be preliminarily mounted along with the shafts of the banking rollers, with the contoured flats 31 that they secure, and optionally with a camshaft 36 accommodated in the same bearing block, on a mount fastened to cylinder head 35.

Figure 4:
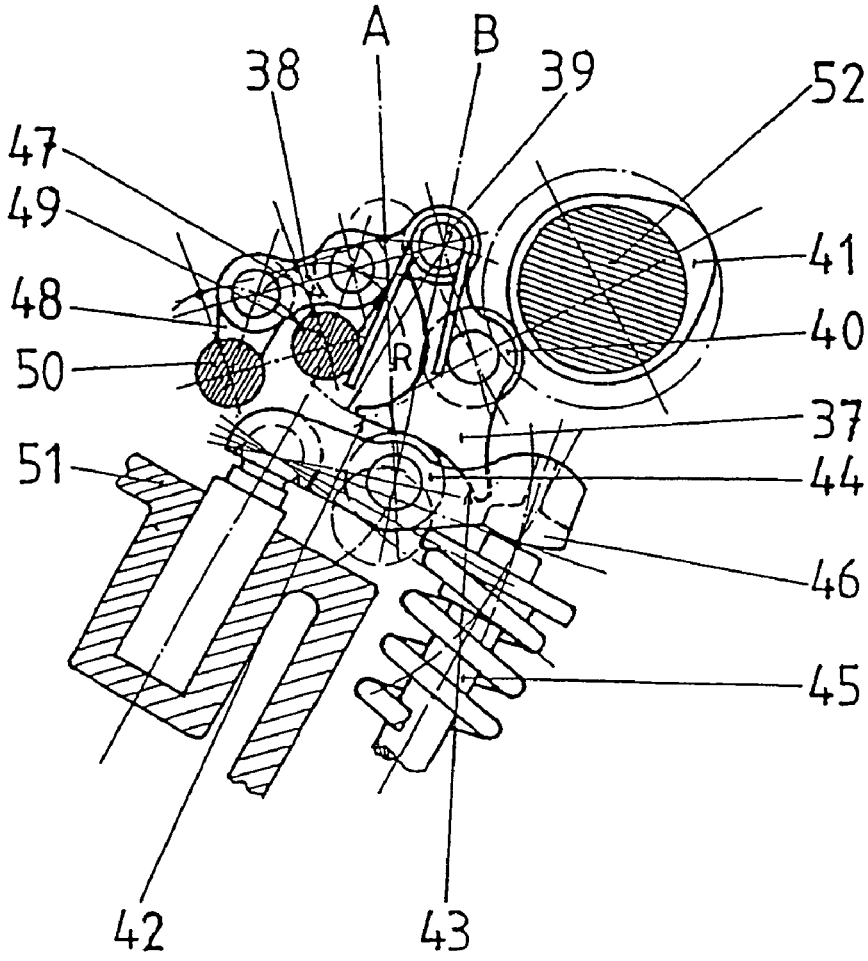
FIG. 4 shows still another embodiment of a mechanism for setting valve controls.

FIG. 4 illustrates a third embodiment of an assembly for mechanically guiding variable valve controls.

The upper end of a one-armed rocker 37 pivots around a swivel 39 accommodated at the end of a cantilever extending out of a steering lever 38. Rocker 37 is driven by a cam 41 by way of a follower 40 more or less half-way along it. At its lower end, rocker 37 is provided with an engagement contour comprising segments 42 and 43. Segments 42 and 43 engage a follower 44 mounted on a walker 46 that actuates a valve 45. Segment 42 participates in maintaining valve 45 closed and segment 43 in allowing it to open. Steering lever 38 is controlled by two cranks 47 and 48, the former mounted on a crankshaft 49 and the latter on a crankshaft 50. The orientation of crankshafts 49 and 50, the structure of steering lever 38 with its three points of articulation impossible to align, the establishment of an appropriate angle, and optionally a differentiation in the lengths of cranks 47 and 48 in the setting vicinity allow the generation of a circular motion that can accurately enough guide the axis of the swivel 39 mounted on rocker 37 around the axis of the follower 44 mounted on walker 46 and in reach as long as valve 45 remains closed.

To allow adjustment of steering lever 38, one of the crankshafts, crankshaft 49, also comprises a controlling shaft. As crankshaft 49 rotates, accordingly, the other crankshaft, crankshaft 50, will be driven by way of steering lever 38 and will also execute a rotation, in that cranks 47 and 48, both, in the adjustment area, are at an appropriate angle to the longitudinal axis of steering lever 38.

The segment 42 of the engagement contour of rocker 37 that participates in maintaining valve 45 closed curves outward in the arc of a circle of radius R with its center coinciding with the axis of the swivel 39 mounted on steering lever 38. The segment 43 associated with the valve's opening stroke is provided with an outward-bent spur that extends considerably beyond segment 42.

As long as the swivel 39 mounted on steering lever 38 is in position A, the mechanism will be set to maintain valve 45 closed. With the swivel in position B, the valve will be able to open with its longest and slowest stroke. As long as valve 45 is maintained closed, outward curving segment 42 will engage the follower 44 mounted on walker 46 without activating the valve. To actuate the valve, the swivel 39 mounted on steering lever 38 will be rotated by a rotation of the controlling-shaft crankshaft 49 along with steering lever 38 out of the position associated with maintaining the valve closed until the spur associated with segment 43 engages the follower 44 mounted on walker 46. The extent of engagement will determine the length and accordingly the duration of the stroke.

Since these mechanisms require only an acute setting angle, the crankshafts 49 and 50 employed therein can be produced from straight round structural section, without bends. Cranks 47 and 48 can be welded to the section for example. Otherwise, bushings can be fastened tight to a length of section to create crankshafts 49 and 50. If the crankshafts are mounted on round section, the articulations for steering lever 38 can be undivided, with steering lever 38 comprising two flat bars.

To facilitate assembly, crankshafts 49 and 50 can be accommodated in bearing blocks to be screwed to a cylinder head 51. The mechanisms intended for a single cylindrical alignment can be preliminarily assembled along with the two crankshafts, with the steering levers 38 mounted thereon, with the rockers 37 articulated to the steering levers by swivels 39, and optionally with a camshaft 52 accommodated in the same bearing blocks, on a mount secured to cylinder head 51.

The invention claimed is:

1. A variable valve control apparatus, comprising:

a valve;

an oscillating arm, one end of which engages with said valve for actuating said valve between a closed position and an open position;

a pivot lever which is pivotably mounted on said oscillating arm via a swivel joint that is situated on said pivot lever, said pivot lever having first and second arms which extend outwardly from said swivel joint;

a cam mounted on a cam shaft and having a camming surface;

a first roller which is rotatably mounted on said first arm of said pivot lever, and engages said camming surface of said cam;

a second roller which is rotatably mounted on said second arm of said pivot lever; and an arcuate sliding block which is disposed within a housing, and which has a contact surface that engages said second roller of said pivot lever; wherein, said contact surface comprises a first region which has an arcuate contour, and which has a radius that is centered on a pivot axis of said swivel joint when said valve is in said closed position, and a second region which adjoins said first region, and which has a curved spur that extends inwardly toward said swivel joint; and said sliding block is slidable along an arcuate path within said housing, about a center of rotation that coincides with a pivot axis of said swivel joint when said valve is in said closed position;

said sliding block is slidable between a first position in which said second roller engages said first region of said contact surface, and a second position in which said second roller engages said second region of said contact surface;

when said sliding block is in said first position, camming movement of said first roller by said camming surface of said cam causes said pivot lever to pivot about said swivel joint, which remains stationary, so that said valve remains closed; and when said sliding block is in said second position, engagement of said second roller with said spur causes said camming movement of said first roller to move said swivel joint downward, and said oscillating arm actuates said valve to an open position.

2. The valve control apparatus according to claim 1, wherein:

said housing includes at least one pressure body which is secured in the housing, and which guides said sliding block along said arcuate path within the housing;

said pressure body has an arcuate toothing arrangement that extends longitudinally along a side thereof, forming a track for guiding said sliding block along said arcuate path;

said sliding block has an arcuate toothing arrangement which extends longitudinally along at least one side thereof, and which is configured to engage with the toothing arrangement of the pressure body;

a pressure generating element applies pressure to a side of said pressure body opposite said toothing arrangement, pressing the toothing arrangements on the sliding block and the pressure body into engagement with each other, whereby the sliding block is guided free of play along said arcuate path within said housing.

3. The valve control apparatus according to claim 2, wherein said longitudinal toothing arrangements are formed of a polyvinyl material.

4. The valve control apparatus according to claim 1, wherein:

said apparatus comprises a plurality of valve controls which are disposed in a row of cylinders; and pressure bodies apply pressure to both sides of said sliding body.

5. The valve control apparatus according to claim 4, wherein said pressure generating element generates a compressive force, using at least one of mechanical springs and hydraulic components using oil pressure of a lubricating system for said cylinders.

6. The valve control apparatus according to claim 1, wherein said apparatus further comprises a toothed wheel that engages with a corresponding toothing arrangement on said sliding block for causing a movement of said sliding block along said arcuate path.

7. The valve control apparatus according to claim 1, wherein said sliding block is driven along said arcuate path by a steering rod.

* * * * *